US008066121B2

(12) United States Patent
Sack et al.

(10) Patent No.: US 8,066,121 B2
(45) Date of Patent: Nov. 29, 2011

(54) CHILD-RESISTANT, SENIOR-FRIENDLY PACKAGE HAVING A SQUEEZE-RELEASE MECHANISM AND METHOD OF ASSEMBLY

(75) Inventors: Ryen Sack, Loves Park, IL (US); Curtis A. Knutson, Loves Park, IL (US); Thomas Moyer, Freeport, IL (US)

(73) Assignee: Anderson Packaging, Inc., Rockford, IL (US)

( * ) Notice: Subject to any disclaimer, the term of this patent is extended or adjusted under 35 U.S.C. 154(b) by 0 days.

(21) Appl. No.: 12/564,694

(22) Filed: Sep. 22, 2009

(65) Prior Publication Data

US 2011/0068039 A1 Mar. 24, 2011

(51) Int. Cl.
*B65D 83/04* (2006.01)

(52) U.S. Cl. ..... 206/531; 220/324; 229/125; 206/540

(58) Field of Classification Search ..... 206/449, 206/450, 1.5, 528–540; 220/324, 326; 229/125, 229/913

See application file for complete search history.

(56) References Cited

U.S. PATENT DOCUMENTS

| | | | | |
|---|---|---|---|---|
| 1,253,489 | A | 1/1918 | Houghland | |
| 3,381,808 | A | 5/1968 | McGraw, II | |
| 3,761,010 | A | 9/1973 | Rosenburg, Jr. | |
| 3,888,350 | A * | 6/1975 | Horvath | 206/531 |
| 4,113,098 | A | 9/1978 | Howard | |
| 4,125,190 | A | 11/1978 | Davie, Jr. et al. | |
| 4,192,422 | A | 3/1980 | Kotyuk | |
| 4,364,488 | A * | 12/1982 | Anjou | 220/281 |
| 5,088,599 | A * | 2/1992 | Mahler | 206/308.1 |
| 5,275,291 | A | 1/1994 | Sledge | |
| 5,339,960 | A | 8/1994 | Price | |
| 6,047,829 | A | 4/2000 | Johnstone et al. | |
| 6,230,893 | B1 | 5/2001 | Karow | |
| 6,412,636 | B1 | 7/2002 | Jones et al. | |
| 6,491,211 | B1 * | 12/2002 | Evans et al. | 229/102 |
| 6,641,031 | B2 | 11/2003 | Evans et al. | |

(Continued)

FOREIGN PATENT DOCUMENTS

EP 1700797 A1 9/2006

*Primary Examiner* — J. Gregory Pickette
*Assistant Examiner* — Raven Collins
(74) *Attorney, Agent, or Firm* — Howson & Howson LLP

(57) ABSTRACT

A package for containing tablets or like separate dispensable items is provided having so-called child-resistant and senior-friendly storage and dispensing properties. An elongate outer sleeve houses a separate blister card carrying tablets or like items. The card slides into the sleeve to a storage position in which the card is housed within the outer sleeve and slides in the reverse direction to a dispensing position in which the card at least partially extends from the open end of the sleeve. The sleeve includes an internal locking restriction secured to a wall thereof, and the card includes a tail end having an integral latch. The locking restriction and latch cooperate to form a locking engagement thereby locking the card within the sleeve when the card is in the storage position. The sleeve includes visually defined squeeze locations on opposite side edges thereof that correspond to a location of the internal locking restriction. The locking engagement of the latch to the internal locking mechanism is released when the outer sleeve is squeezed at the visually defined squeeze locations. The construction of the outer sleeve from a paperboard blank, the construction of a blister card having a latch, and a method of assembling the above referenced package are also disclosed.

10 Claims, 6 Drawing Sheets

U.S. PATENT DOCUMENTS

| | | | | |
|---|---|---|---|---|
| 6,752,272 | B2 | 6/2004 | Jones et al. | |
| 6,848,577 | B2 * | 2/2005 | Kawamura et al. | 206/449 |
| 6,874,636 | B2 | 4/2005 | Paliotta et al. | |
| 6,976,576 | B2 * | 12/2005 | Intini | 206/1.5 |
| 7,090,079 | B2 | 8/2006 | Ehrlund | |
| 7,389,875 | B2 | 6/2008 | Sandberg et al. | |
| RE40,612 | E | 12/2008 | Paliotta et al. | |
| 7,581,642 | B2 | 9/2009 | Knutson et al. | |
| 2004/0099565 | A1 | 5/2004 | Dehlin et al. | |
| 2005/0183981 | A1 | 8/2005 | Gelardi | |
| 2007/0045149 | A1 | 3/2007 | Hession | |
| 2007/0068843 | A1 * | 3/2007 | Hession | 206/538 |
| 2007/0102318 | A1 | 5/2007 | Gelardi et al. | |
| 2007/0181458 | A1 * | 8/2007 | Ehrlund | 206/528 |
| 2007/0199857 | A9 | 8/2007 | Baker et al. | |
| 2007/0251983 | A1 | 11/2007 | Freeze | |
| 2007/0272586 | A1 | 11/2007 | Hession | |
| 2008/0093252 | A1 | 4/2008 | Hession | |
| 2008/0135606 | A1 | 6/2008 | Weston et al. | |
| 2008/0217204 | A1 | 9/2008 | Sattel et al. | |
| 2008/0217205 | A1 | 9/2008 | Sattel et al. | |
| 2008/0217390 | A1 | 9/2008 | Sattel et al. | |
| 2008/0251410 | A1 | 10/2008 | Gelardi | |
| 2009/0045078 | A1 | 2/2009 | Gelardi et al. | |
| 2009/0045096 | A1 | 2/2009 | Knutson et al. | |
| 2009/0178948 | A1 | 7/2009 | Reilley et al. | |
| 2009/0178949 | A1 | 7/2009 | Reilley et al. | |
| 2009/0184022 | A1 | 7/2009 | Coe et al. | |

* cited by examiner

CHILD-RESISTANT, SENIOR-FRIENDLY PACKAGE HAVING A SQUEEZE-RELEASE MECHANISM AND METHOD OF ASSEMBLY

BACKGROUND OF THE INVENTION

The present invention relates to a package for containing separate items, such as pills, tablets, doses of medicine, or the like, that can be stored therein and dispensed therefrom by an intended end-user, and more particularly, the present invention relates to a package including an outer sleeve housing a blister card that is slidable into and out of the sleeve whereby the structures of the sleeve and blister card interact to provide child-resistant, senior-friendly dispensing properties.

Simply by way of general example, a paperboard carded package including a blister card is disclosed by U.S. Patent Application Publication No. 2009/0178949 A1 of Reilley et al. assigned to Anderson Packaging, Inc., the assignee of the present application.

Although the above referenced carded package disclosed by the above referenced published application may be satisfactory for its intended purpose, there remains a need for a package of novel construction that provides a desired amount of child-resistance, yet from which tablets or the like can be readily dispensed by an intended end-user, such as a senior citizen. Further, there is a need for a novel and cost efficient method of assembling such a package.

BRIEF SUMMARY OF THE INVENTION

According to the present invention, a package for containing tablets or like separate dispensable items is provided having so-called child-resistant and senior-friendly storage and dispensing properties. An elongate outer sleeve has an open end, closed end, and opposite side edges and defines a void therein for housing a separate card carrying tablets or like items. The card slides into the outer sleeve to a storage position in which the card is housed within the outer sleeve and in which access to the tablets or like items is prevented by the outer sleeve. The card slides in the reverse direction relative to the outer sleeve to a dispensing position in which the card at least partially extends from the open end of the outer sleeve thereby exposing the tablets or like items to be dispensed. The outer sleeve has an internal locking restriction secured to a wall thereof, and the card has a tail end with an integral latch. The locking restriction of the outer sleeve and the latch of the card cooperate to form a locking engagement thereby locking the card within the outer sleeve when the card is in the storage position. The outer sleeve includes visually defined squeeze locations on the opposite side edges thereof that correspond to a location of the internal locking restriction. The locking engagement of the latch to the internal locking mechanism is released when the outer sleeve is squeezed at the visually defined squeeze locations.

Various additional features, which are optional, are contemplated for the above referenced package. For example, the width of the card can closely match that of the void provided by the sleeve so that the sleeve is difficult to squeeze, except at the desired squeeze locations in which the width of the card is reduced for this purpose. In addition, the internal locking restriction can be provided as a ledge that extends transversely across the void and that is of a predetermined thickness thereby reducing a predetermined height of the void thereby creating a restriction to the movement of the latch. However, when the opposite side edges of the outer sleeve are squeezed toward one another at the designated squeeze locations of the sleeve, the ledge is arched upward to release the latch from the locking engagement and to permit withdrawal of the card from the sleeve. Further, the card can include a reversely-folded flap adjacent the latch that is folded underneath the card and engages a surface of the sleeve for purposes of urging the card and latch in a direction into the locking engagement with the ledge.

In some contemplated embodiments, the sleeve can be made of a single die cut paperboard blank that is folded and bonded to form the structure of the outer sleeve. In addition, the card can be a blister card that includes a transparent plastic strip having a plurality of separate blister compartments and the latch. The card can also include one or more layers of paperboard to provide the card with needed rigidity to resist squeezing of the sleeve at locations other than the designated squeeze locations.

According to another aspect of the present invention, a paperboard blank for an outer sleeve of a child-resistant, senior-friendly package that contains tablets or like separate dispensable items is provided. The single integral blank includes upper and lower wall panels separated by a pair of fold lines defining a first side edge panel therebetween. The blank also includes a second side edge panel extending via a fold line from the lower wall panel opposite the first side edge panel. Further, the blank includes a ledge forming panel extending adjacent the second side edge panel such that, when folded and bonded, the ledge forming panel forms a ledge on an internal surface of the upper wall panel and provides a locking restriction within the outer sleeve to which a blister card can be captured.

According to yet another aspect of the present invention, a method of assembling a child-resistant, senior-friendly package for containing tablets or like separate dispensable items is provided. A paperboard blank is die-cut, folded, and bonded together to form an outer sleeve having a locking ledge formed on an internal surface of a wall panel of the outer sleeve. A blister card is formed from at least one strip of paperboard and at least one transparent plastic sheet having blister compartments and/or a latch molded therein. The blister card is inserted into an open end of the outer sleeve to a storage position in which the locking ledge and the latch cooperate to form a locking engagement in which the blister card is locked in the storage position within the outer sleeve. A step of unlocking the latch from the ledge is accomplished by squeezing opposite side edges of the outer sleeve adjacent the ledge to cause the ledge to arch upwardly thereby releasing the latch from capture by the ledge.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
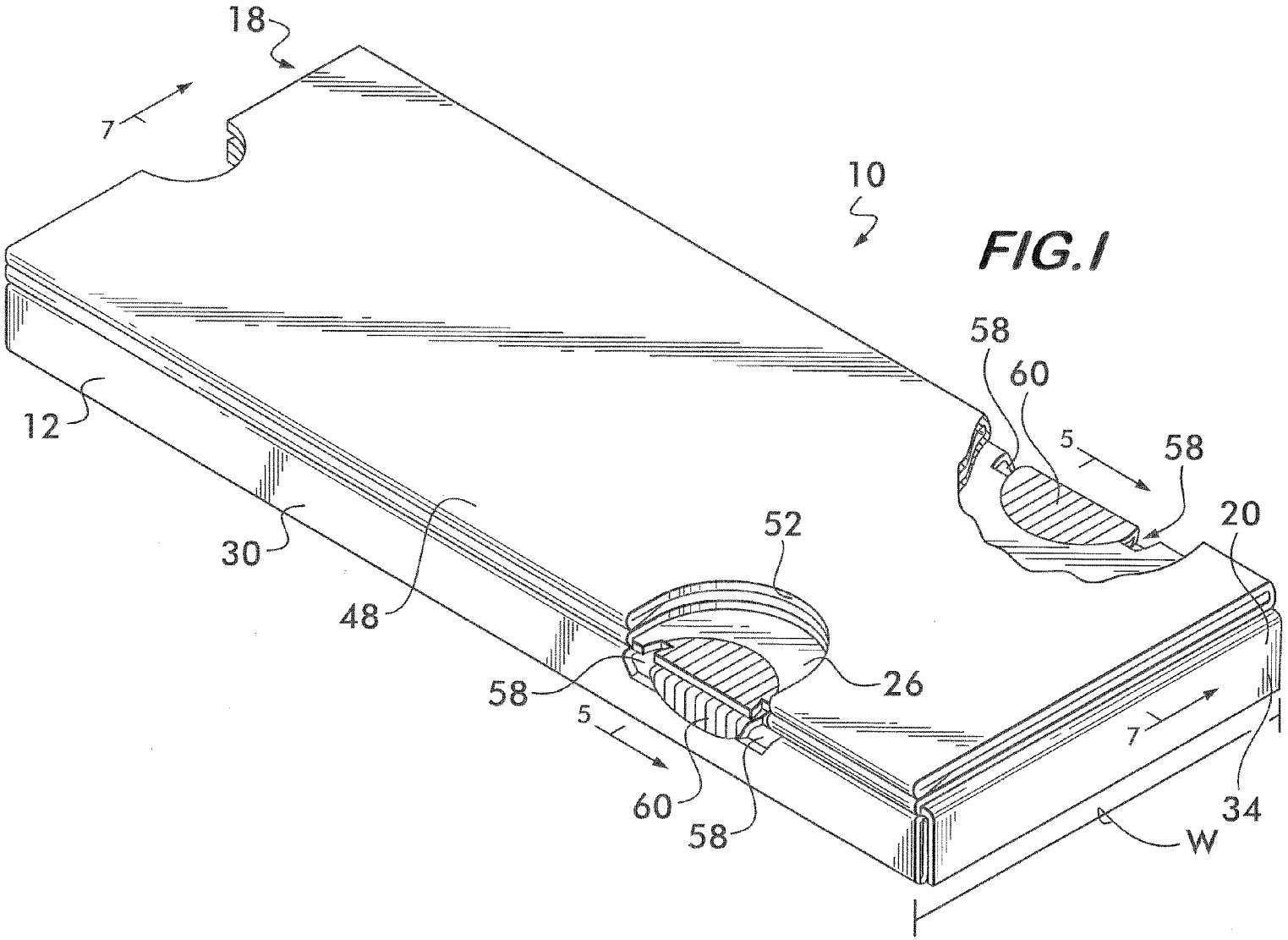
FIG. 1 is perspective view of a package assembly according to the present invention.

A fully assembled package 10 according to the present invention is illustrated in FIG. 1. The package is generally thin, elongated and rectangular and includes a relatively-rigid outer sleeve 12 that houses a separately-manufactured, relatively-rigid blister card 14 or the like that has a set of individual blister compartments 16 each initially containing a pill, tablet and/or like separate small item (not shown). In FIG. 1, the blister card 14 is in a storage position in which the sleeve 12 fully contains the blister card 14 and prevents access to the blister compartments 16 that are protected within the package 10. In this condition, the pills, tablets and/or like separate small items are hidden from view so that they do not attract the interest of young children.

Figure 9:
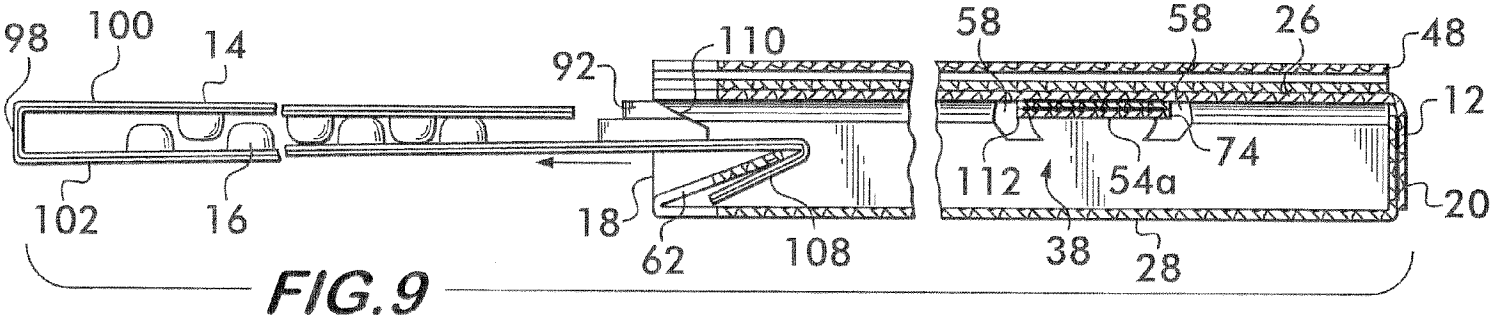
FIG. 9 is a partial cross-sectional view of the package of FIG. 1 showing a condition in which the blister card is fully extended from the outer sleeve of the package.

For purposes of dispensing a pill, tablet and/or like separate small item from the package 10, the blister card 14 can be slid relative to the outer sleeve 12 through an open end 18 of the sleeve 12 to a dispensing position, for instance, as best illustrated in FIG. 9. In this position, the blister card 14 can be unfolded (if required) and one or more blister compartments 16 can be accessed for dispensing a pill, tablet and/or like separate small item therefrom.

Figure 7:
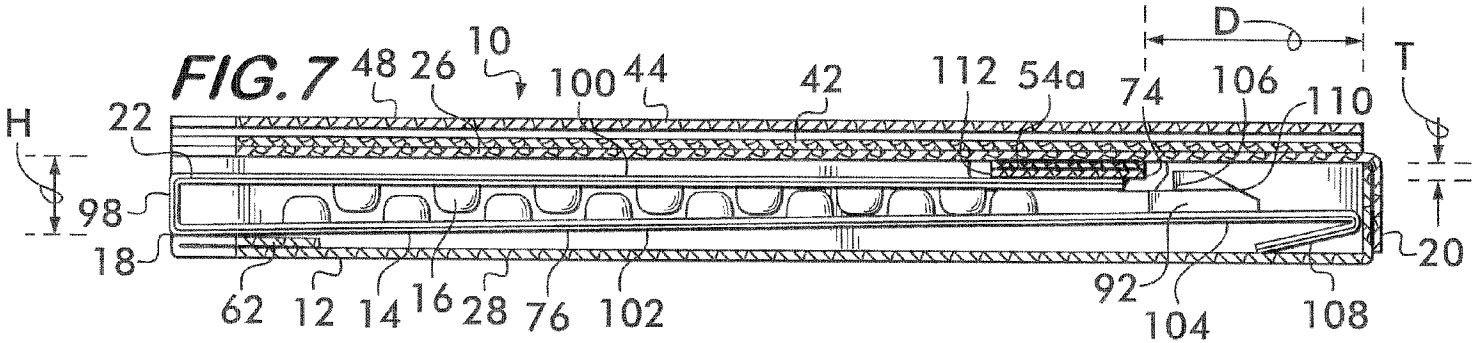
FIG. 7 is a cross-sectional view along a longitudinal centerline of the package of FIG. 1 along line 7-7 of FIG. 1.

A feature of the package 10 of the present invention is that it includes a locking and squeeze-release mechanism that provides child-resistant properties. When the blister card 14 is fully inserted into the outer sleeve 12 (i.e., in the storage position) as shown in FIG. 7, the blister card 14 is locked therein and cannot be removed from the outer sleeve 12 without simultaneously accomplishing multiple tasks that are considered difficult for a young child to accomplish. For example, specific locations of the outer edges of the outer sleeve 12 adjacent a closed end 20 of the sleeve 12 are required to be squeezed while an exposed leading edge 22 of the blister card 14 is gripped and pulled through the open end 18 of the outer sleeve 12.

These simultaneous actions are difficult for a young child to accomplish for the following reasons. The width "W" of the package 10 is such that a young child's hand is not expected to be sufficiently large as to be able to grasp about the width "W" which is otherwise required to squeeze the package 10 with a single hand. Also, the simultaneous actions of squeezing the package 10 at one end 20 of the package and pulling the blister card 14 forward at the opposite end 18 of the package 10 requires a certain level of dexterity not expected of a young child.

However, it should be noted that an adult, including a senior citizen, should readily be able to operate the package 10. One hand of the adult should be able to readily grip and squeeze the package 10 adjacent the closed end 20 and the other hand of the adult should be able to grip and pull the exposed leading edge 22 of the blister card 14 at the opposite open end 18 of the package 10. After the blister card 14 is fully extended from the package 10 in a dispensing position (see FIG. 9), the blister card 14 can be unfolded (if required) to expose the blister compartments 16. Thereafter, force can be exerted on one of the blister compartments 16 to break the contained tem through an underside of the blister card 14 that seals the item within the blister compartment 16. Thereafter, the blister card 14 can be folded (if necessary) and pushed back into the sleeve 12 to return the blister card 14 to the storage position. When this occurs, the locking mechanism is automatically actuated and the blister card 14 is once again locked within the outer sleeve 12 as discussed above.

In the illustrated embodiment of the present invention, the outer sleeve 12 and some of the layers of the blister card 14 are made of paperboard or like sheet material. For example, the sheet material can be a SBS (solid bleached sulfate) paperboard stock material of a desired thickness. This type of material can be provided in a relatively flat blank form on which panels, fold lines, cutouts, openings, perforations, ribbing, or the like can be readily formed and/or defined. In addition, the material of the blank should be capable of being coated with a continuous or discontinuous layer of a heat and/or pressure activated adhesive at desired locations. Further, certain sides of the blanks should be glossy or otherwise of a desired texture and/or appearance for forming the visible external surfaces of the package 10. Although the use of paperboard is discussed throughout this application, it should be clear that other materials can also be utilized, such as, molded materials, composite materials, plastic materials, metal, paper, or the like.

Figure 2:
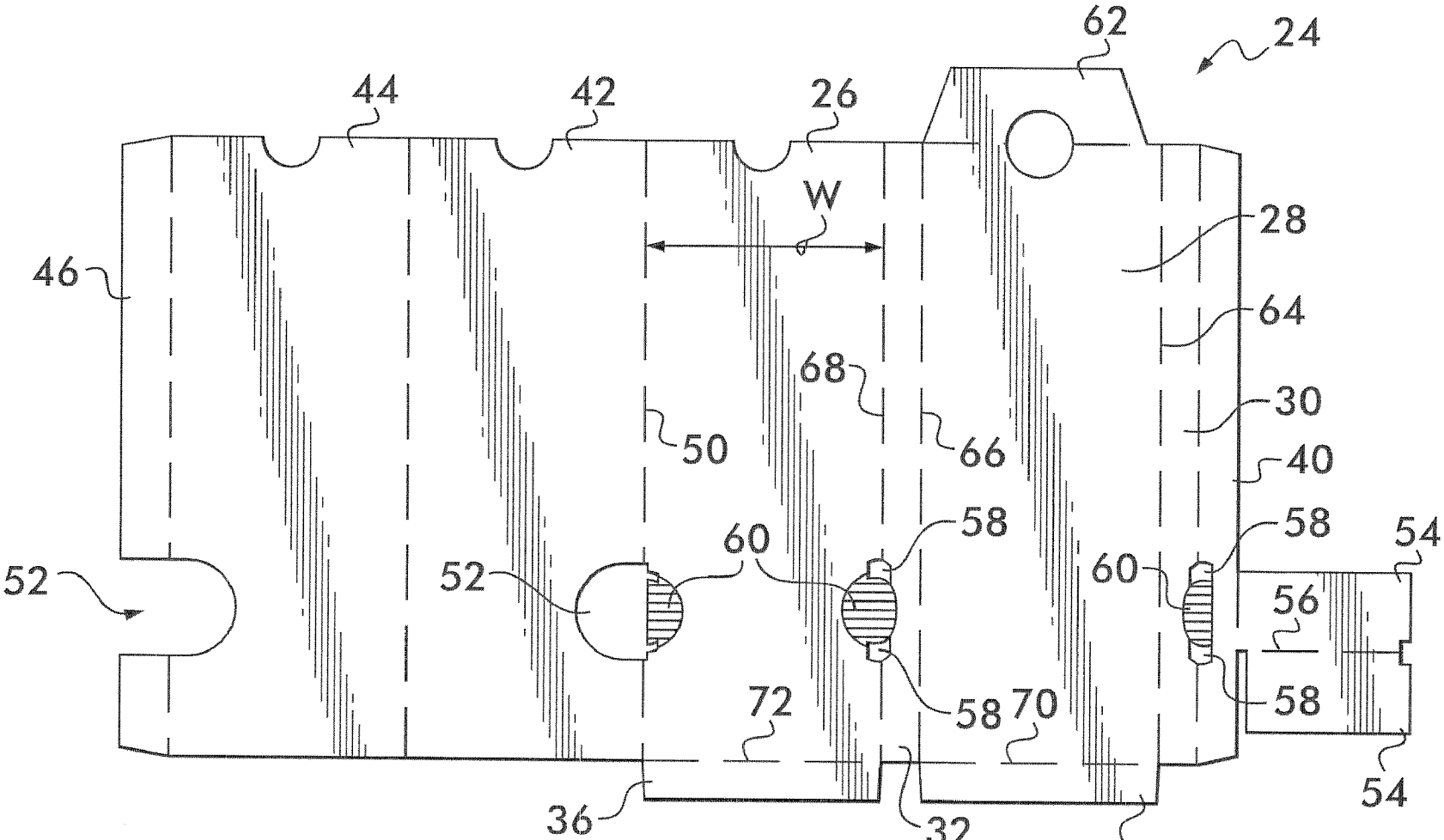
FIG. 2 is a plan view of a die cut paperboard blank used to make a paperboard sleeve of the present invention.

Turning first to the construction of the outer sleeve 12 of the package 10, a blank 24 of material is shown in FIG. 2 that can be used to form the sleeve 12. This blank 24 can be made of a single integral sheet of material that has been die cut into the shape shown in FIG. 2 and that can have pre-defined fold lines, cutouts, and the like. It can also be coated at various locations with a heat or pressure activated adhesive layer used to secure the blank 24 into the desired configuration of the sleeve 12.

The blank 24 of FIG. 2 includes a substantially-rectangular, relatively-large upper wall panel 26, a substantially-rectangular, relatively-large lower wall panel 28, a pair of relatively-thin side edge panels 30 and 32, and one or more end flaps 34 and 36. When the sleeve 12 is assembled, these panels 26, 28, 30 and 32 and flaps 34 and 36 essentially form a thin, elongate box-like structure having an open end 18, a closed end 20, and a void 38 therein in which the blister card 14 can be received and housed. The blank 24 can include a securement flap 40 for purposes of adhesively securing the above referenced panels 26, 28, 30 and 32 in the desired configuration.

In addition, the blank 24 can include one or more cover panels, 42 and 44, that can be attached together with a securement flap 46 or the like and can provide a book-style cover 48 for the assembled package 10. This cover 48 is connected via a fold line 50 to the upper wall panel 26 of the blank 24 and can be used solely for purposes of displaying or holding information, instructions, logos and the like and/or for aesthetic purposes. The use of the book-style cover 48 is optional, and the package 10 can be provided without cover panels 42 and 44, if desired. If present, the cover panels 42 and 44 include cutout sections 52 that ensure that the cover panels 42 and 44 do not interfere with the squeeze-release mechanism of the package 10.

With respect to the locking mechanism of the package 10, the blank 24 includes one or more ledge-creating panels 54. The ledge panels 54 ultimately are used to form a ledge 54 or like restriction that interferes with the free passage of a stopper, catch, latch or the like of the blister card as is discussed in greater detail below. The ledge panels 54 essentially reduce the height "H" of the void 38 of the sleeve 12 where the ledge 54 extends within the sleeve 12 to provide an interference or restriction to removal of the blister card from the storage position within the outer sleeve 12. In FIG. 2, a pair of ledge panels 54 separated by a fold line 56 is illustrated, and these panels 54 extend from the securement flap 40 at a location close to the end flaps 34 and 36 of the blank 24. These panels 54 are folded and secured together, such as with an adhesive, such that a predetermined thickness "T" of the ledge 54*a* of the assembled sleeve 12 can be provided. If less thickness is desired, only a single ledge panel 54 can be used; alternatively, if a greater thickness is required, three or more ledge panels 54 can be folded and secured together.

At the location of the sleeve 12 corresponding to the opposite ends of the ledge 54*a*, the blank 24 includes cutout sections 58 and ribbed sections 60 therebetween defining locations on the sleeve 12 where the sleeve 12 should be squeezed for purposes of unlocking a blister card 14. The cutouts 58 and ribbed sections 60 not only provide a visual indication to the end-user of where the outer sleeve 12 should be squeezed, but also facilitate the intended result of squeezing the sleeve 12. The intended result of squeezing the package 10 at this location is to cause the ledge 54*a* of the sleeve 12 to become upwardly arched or bowed thereby temporarily increasing the height "H" of the void 38 of the sleeve 12 at the location of the ledge 54*a*. The cutouts 58 and ribbed sections 60 provide a balance between the needed flexibility and resiliency of this part of the sleeve 12 and the needed reinforcement to prevent damage to the sleeve 12.

Finally, the blank 24 includes a locking flap 62 extending from the lower wall panel 28 adjacent the open end 18 of the sleeve 12. In use, the locking flap 62 is reversely-folded within the void 38 of the sleeve 12 and cooperates with a like reversely-turned flap of the blister card 14 to prevent complete separation and removal of the blister card 14 from the sleeve 12. For this purpose, the locking flap 62 is located at the open end 18 of the sleeve 12 opposite from the end flaps, 34 and 36.

Figure 4:
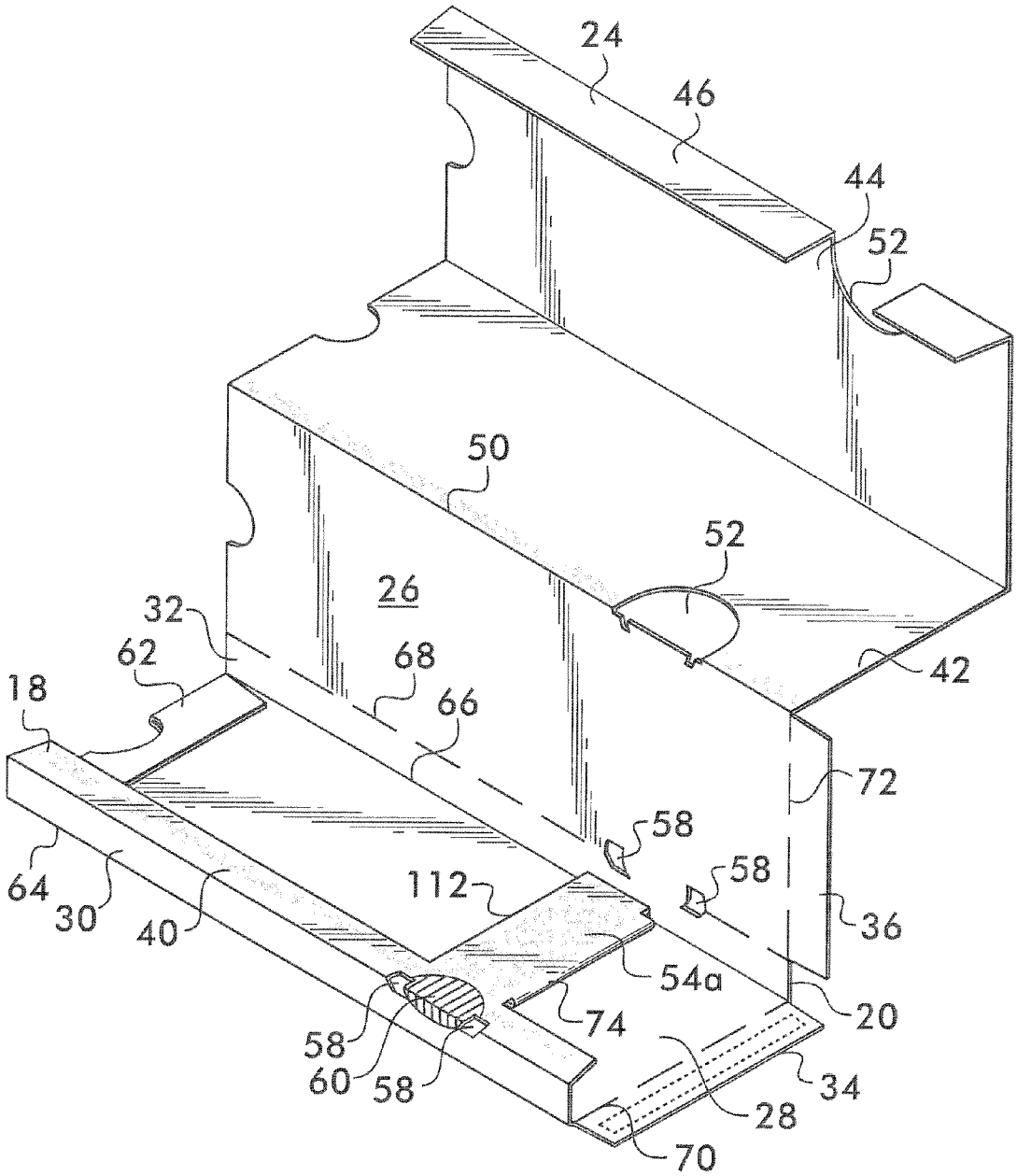
FIG. 4 is a perspective view of the paperboard blank of FIG. 2 shown partially folded.

FIG. 4 shows a sleeve 12 partially assembled from the blank 24. The side edge panels 30 and 32 of the blank 24 are folded at right angles along fold lines 64 and 66 as is the securement flap 40. In addition, the ledge panels 54 are folded and glued together and are shown in a transverse position for being adhesively secured or bonded to the upper wall panel 26 on the inside of the sleeve 12. Further, the locking flap 62 is reversely-folded inward at the open end 18 of the sleeve 12. Accordingly, when the upper wall panel 26 of the sleeve 12 is folded along fold line 68, the upper wall panel 26 can be adhesively secured to the securement flap 40 and to the ledge 54. In addition, the end flaps 34 and 36 are folded along fold lines 70 and 72 and glued together to seal the closed end 20 of the outer sleeve 12. Finally, the securement flap 46 of the cover panel 44 is adhesively secured t to the cover panel 42 to complete assembly of the cover 48.

The result of the above referenced folding and gluing of the above referenced blank 24 is the formation of an outer sleeve 12 that is generally elongate and thin and provides a generally rectangular inner void 38. A book style cover 48 is provided for aesthetic purposes and to display and hold information, and a pair of squeeze locations are well defined on opposite side edges of the outer sleeve 12. The internal locking ledge 54*a* is located adjacent the closed end 20 of the sleeve 12 but is spaced a distance "D" therefrom to permit adequate spacing for seating of the latch, catch or stopper of the blister card 14 between the closed end 20 of the sleeve 12 and the rear locking edge 74 of the ledge 54*a*.

Figure 3:
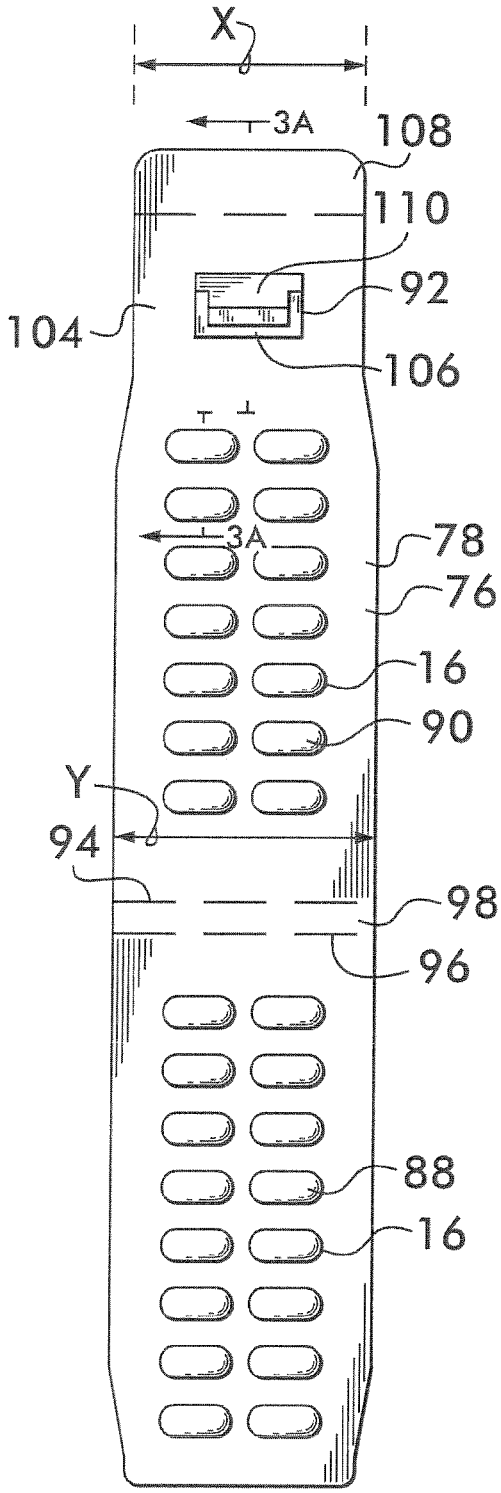
FIG. 3 is a plan view of a blister card according to the present invention.
Figure 3A:
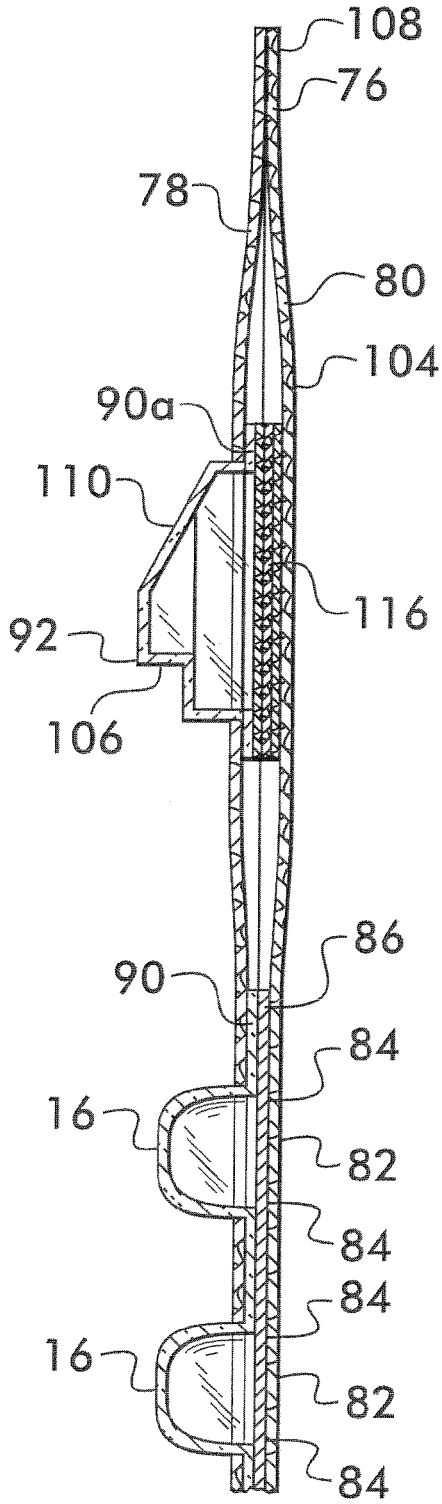
FIG. 3A is a cross-sectional view of the blister card along line 3A-3A of FIG. 3.

Referring to the structure of the blister card 14, it is best illustrated in FIGS. 3 and 3A. The illustrated blister card 14 includes an elongate, generally-planar strip 76 and a plurality of raised blister compartments 16. In one contemplated embodiment, the elongate strip 76 includes two layers, 78 and 80, of heal-sealable paperboard or the like stacked together. The first layer 78 includes a plurality of openings through which the blister compartments 16 can extend. The second layer 80 includes a plurality of break-away tabs 82 defined by perforations 84. The break-away tabs 82 register with the blister compartments 16 and provide a higher level of child resistance. For example, to force a pill, tablet or like item through the rear side of the blister card 14, sufficient force must be exerted not only to break through a foil backing 86 or the like, but also to break the break-away tab 82 that overlies the foil backing 86.

The two layers 78 and 80 are preferably heat-sealed together with an adhesive layer and sandwich and hold a pair of transparent plastic sheets 88 and 90 therebetween. The plastic sheets 88 and 90 are molded such that they provide the blister compartments 16 and include a foil backing layer 86. A separate plastic sheet 90*a* or the like can also be molded to include a hollow latch, catch or stopper structure 92. Alternatively, the latch 92 can be molded as a part of plastic sheet 90, or the latch 92 can be a solid structure adhesively secured in place. The assembly shown in FIG. 3A provides a secure and reliable means of securing the latch 92 to the blister card 14, and one or more reinforcement panels 116 of paperboard or the like can be located directly underneath the latch 92 to rigidify this area of the blister card 14. In addition, the latch 92 can be molded with ribs, indentations or the like to reinforce the structure of the hollow latch 92 to prevent unwanted denting or like damage.

Figure 8:
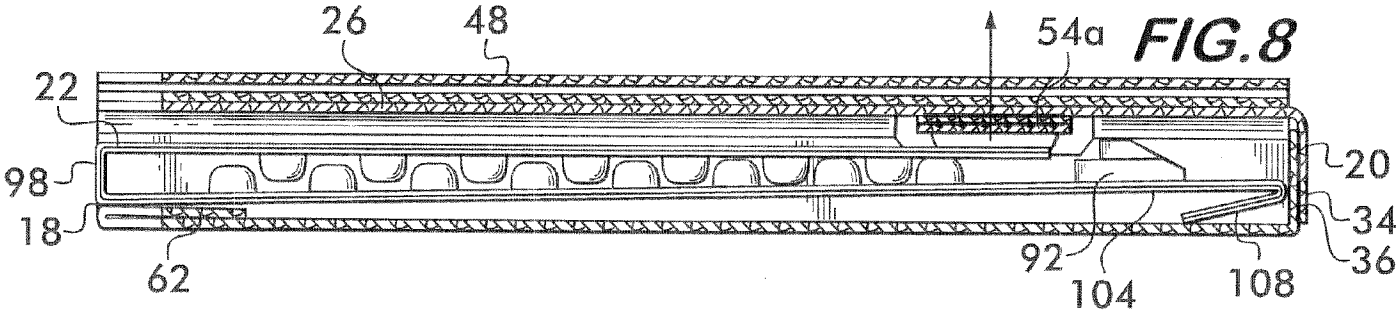
FIG. 8 is a cross-sectional view similar to FIG. 7, except that the package is shown in a condition of being squeezed to enable release of the blister card from the outer sleeve.

In the embodiment illustrated in FIG. 3, the blister card 14 includes a pair of intermediate fold lines 94 and 96 defining a thin intermediate panel section 98. Thus, before the blister card 14 is inserted into the sleeve 12, it is folded as shown in FIGS. 7 and 8. In the folded condition, the blister compartments 16 of sheets 88 and 90 face each other and are located between top and bottom walls, 100 and 102, of the folded blister card 14. The intermediate panel section 98 becomes an end wall of the folded blister card 14 and, as shown in FIGS. 7 and 8, provides an end wall 98 substantially closing the open end 18 of the outer sleeve 12. Thus, a young child or the like cannot look into the open end 18 and see the blister compartments 16 and their contents thereby providing no visual stimulus which might otherwise encourage a young child to attempt to gain access to the contents of the package 10.

The tail end 104 of the bottom wall 102 of the folded blister card 14 extends beyond the top wall 100 of the folded blister card 14 and provides the location of the stopper, catch or latch 92. As shown in FIGS. 7 and 8, the latch 92 projects upward from the bottom wall 102 of the folded blister card 14 and essentially extends to the upper wall panel 26 of the outer sleeve 12. The profile or shape of the latch 92 shown in FIGS. 7 and 8 includes a stepped-shaped front wall 106 that closes accommodates the corner shape of the rear locking edge 74 of the ledge 54*a*. Thus, these opposing surfaces mate together and prevent passage of the latch 92 beyond the ledge 54 thereby locking the blister card 14 in the storage position within the sleeve 12.

In addition, the tail end 104 includes a reversely-turned flap 108 that extends between the lower wall panel 28 of the sleeve 12 and the bottom wall 102 of the folded blister card 14 adjacent the latch 92. In this position, the reversely-folded flap 108 functions as a spring to urge the tail end 104 and latch 92 upward toward the upper wall panel 26 of the sleeve 12 and into secure engagement with the ledge 54*a*. This prevents unwanted passage of the latch 92 forwardly beyond the ledge 54*a* and ensures a secure locking engagement of the latch 92 with the ledge 54*a*.

Figure 5:
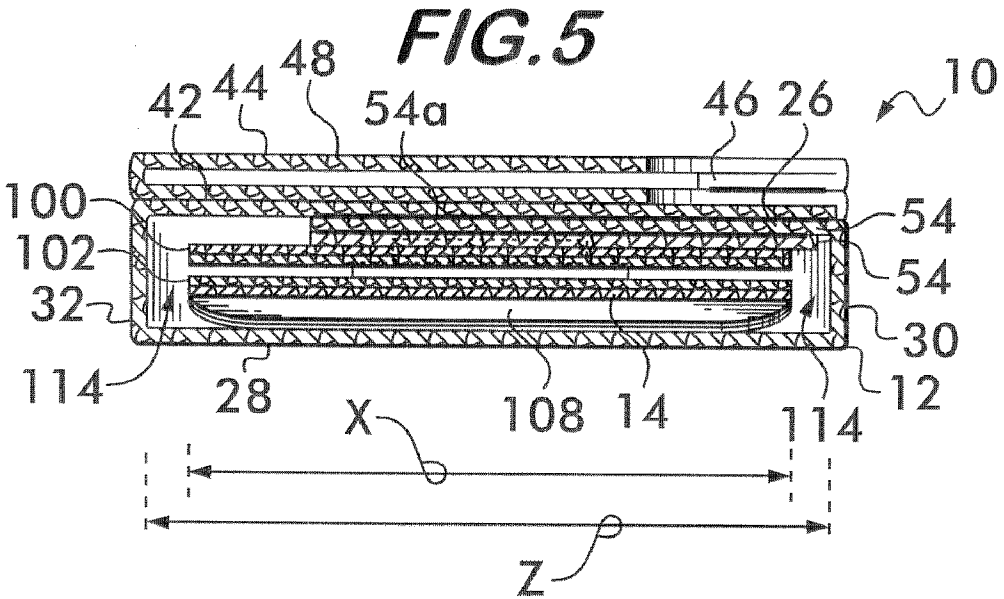
FIG. 5 is a cross-sectional view across the squeeze-release mechanism of the package of FIG. 1 along line 5-5 of FIG. 1.

Further, the tail end 104 and/or portions of the blister card 14 adjacent the tail end 104 has a narrower width "X" than the width "Y" of the remaining parts of the blister card 14. The purpose for this is to prevent a young child or the like from squeezing the package 10 at locations other than that intended. For example, the width "Y" of the blister card 14 closely matches the width "Z" of the void 38 defined by the sleeve 12. Thus, the rigidity of the blister card 14, itself, where it has the width "Y" will resist squeezing of the opposite side edges of the sleeve 12. For instance, squeezing the side edges of the sleeve 12 adjacent the open end 18 or intermediate portion of the sleeve 12 is difficult due to the presence of the blister card 14 and its width "Y". Thus, squeezing is prevented at these locations. However, the reduced width "X" of the tail end 104 of the blister card 14 ensures an open air space or gap 114 exists within the sleeve adjacent opposite sides of the tail end 104 and latch 92. For example, see gaps 114 in FIGS. 5 and 6. These gaps do not exist within other areas of the sleeve 12. The gaps 114 permit relatively easy squeezing of the side edges of the sleeve 12 to arch the ledge 54*a*. Thus, only this location of the sleeve 12 can be squeezed.

Figure 6:
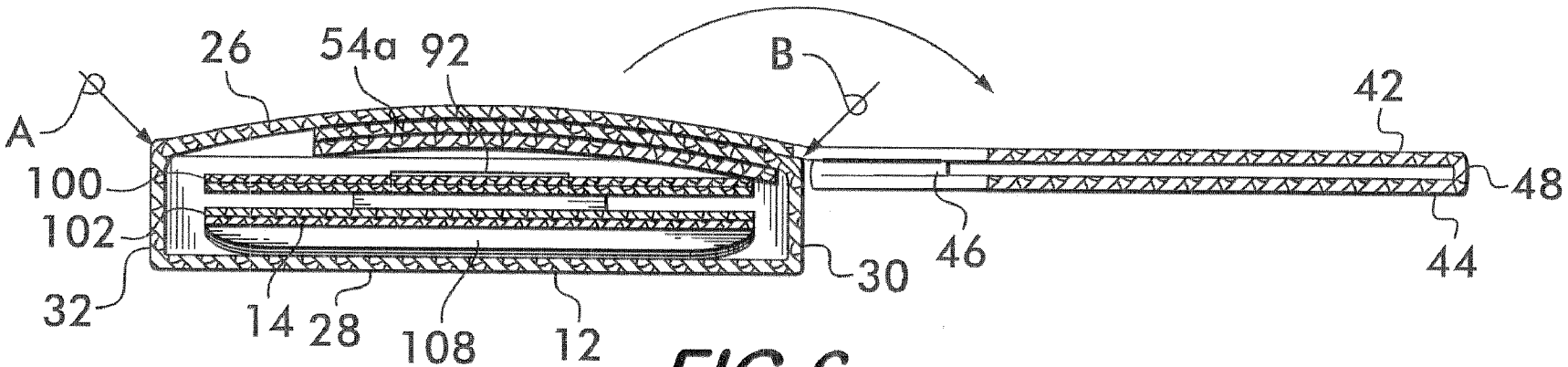
FIG. 6 is a cross-sectional view similar to FIG. 5, except that the package is shown in a condition of being squeezed to enable release of the blister card from the outer sleeve.

When a user squeezes the opposite side edges of the sleeve 12 at locations corresponding to the opposite ends of the ledge 54*a*, the ledge 54*a* readily bows or arches upward away from the latch 92 thereby affording clearance for the latch 92 underneath the ledge 54*a*. For example, see arrows "A" and "B" defining the squeezing directions and note the arched-shape of the ledge 54*a* and upper panel wall 26 in FIG. 6. When the ledge 54*a* is arched as shown in FIG. 6, a user can grip the exposed leading edge 22 of the folded blister card 14 and slide the blister card 14 forward through the open end 18 of the sleeve to the position shown in FIG. 9.

In the dispensing position illustrated in FIG. 9, the reversely-folded flap 108 of the blister card 14 catches and interlocks with the oppositely reversely-folded locking flap 62 of the sleeve 12 and prevents complete separation of the blister card 14 from the sleeve 12. Thus, even in the dispensing position, the blister card 14 remains attached and tethered to the sleeve 12 and complete separation is prevented.

When the blister card 14 is re-folded, it can be slid in a reverse direction back through the open end 18 of the sleeve toward the storage position. For this purpose, the latch 92 includes a rear wall 110 provided with a ramped or tapered shape. This permits the front edge 112 of the ledge 54*a* to readily ride up the rear wall 110 of the latch 92 so that the latch 92 can pass beyond the ledge 54*a* toward the closed end 20 of the sleeve 12. After the latch 92 is slid beyond the rear locking edge 74 of the ledge 54*a*, the latch 92 is forced upward via the spring action of the reversely-turned flap 108 of the tail end 104 of the blister card 14 and becomes locked behind the ledge 54*a*. Thus, the blister card 14 is easily inserted back into the sleeve 12 and automatically becomes locked within the sleeve 12 when fully inserted to the storage position. These locking and squeeze release actions can be repeated throughout the life of the package 10. When all items have been dispensed form the package 10, the package can be discarded, or more preferably, recycled.

Various modifications to the package and its method of assembly can be used. For instance, the number, shape and configuration of the various panels and flaps of the blank 24 can be altered. The shape, size and/or pattern of the perforations, cutouts, ribbing and the like can be changed. Different types of adhesives and other means to bond the panels of the carded package together can be used. Different materials within a range of different thicknesses can be used. The shape, location and configuration of the ledge and the latch can be altered. In addition, the blister card can be provided in a non-folding form such that folding and unfolding is not required.

While preferred packages and methods of assembly have been described in detail, various modifications, alterations, and changes may be made without departing from the spirit and scope of the package and method according to the present invention as defined in the appended claims.

The invention claimed is:

1. A child-resistant, senior-friendly package for containing tablets or like separate dispensable items, comprising:

an elongate outer sleeve having an open end, closed end, and parallel opposite side edges extending from said open end to said closed end, said sleeve defining a void therein of a constant predetermined width as measured between said parallel opposite side edges; and a separate card having a face carrying the tablets or like items, said face extending transversely between said parallel opposite side edges of said outer sleeve, said card being slidable into said outer sleeve to a storage position in which said card is housed within said outer sleeve and access to the tablets or like items are prevented by said outer sleeve and a dispensing position in which said card is at least partially slid through said open end of said outer sleeve to expose the tablets or like items outside of said outer sleeve;

said outer sleeve having an internal locking restriction secured to a wall thereof and said card having a tail end with a latch, said locking restriction of said outer sleeve and said latch of said card cooperating to form a locking engagement to lock said card within said outer sleeve in said storage position;

said outer sleeve having visually-defined squeeze locations on said opposite side edges that correspond to a location of said internal locking restriction such that said locking engagement between said internal locking mechanism and said latch is released when said outer sleeve is squeezed at said squeeze locations on said opposite side edges of said outer sleeve;

said card having a first predetermined width except at said tail end, said first predetermined width of said card closely matching said constant predetermined width of said void to prevent squeezing of said outer sleeve where said card is of said first predetermined width;

said tail end of said card having a second width that is less than said constant predetermined width of said void thereby creating gaps between side edges of said tail end and said opposite parallel side edges of said outer sleeve at said visually-defined squeeze locations on said opposite side edges of said outer sleeve and thereby permitting squeezing of said outer sleeve between said opposite side edges of said outer sleeve only at said visually-defined squeeze locations which corresponds to said location of said internal locking restriction and said latch;

said internal locking restriction being a ledge that extends transversely across said void from one of said opposite side edges of said outer sleeve toward said other of said opposite side edges of said outer sleeve and being of a predetermined thickness that reduces a predetermined height of said void, and said ledge becoming arched upwardly away from said latch when said visually-defined squeeze locations on said opposite side edges of said outer sleeve are squeezed toward one another to release said locking engagement of said latch from said ledge;

said card being a blister card having a first face with a plurality of separate blister compartments projecting therefrom and an opposite face from which blister compartments do not extend, said latch projecting from said first face of said blister card and has a front wall with a stepped face for accommodating a mating contour of said ledge in said locking engagement, and said latch having a rear wall with a smooth taper to permit said latch to readily pass by said ledge when said card is returned to said storage position; and said card including a reversely-folded flap extending from said tail end and adjacent said latch that is folded in a direction toward said opposite face of said blister card and away from said latch and said ledge such that said flap is located underneath said card and engages a surface of said outer sleeve underneath said card for purposes of urging said card and latch in a direction into said locking engagement with said ledge.

2. A package according to claim 1, wherein said outer sleeve has a reversely-folded locking flap adjacent said open end, and wherein said reversely-folded locking flap of said outer sleeve lockingly engages said reversely folded flap of said card when said card is in said dispensing position to prevent complete separation of said card from said outer sleeve.

3. A package according to claim 1, wherein said outer sleeve is made of a single die cut paperboard blank that is folded and bonded to form said outer sleeve.

4. A package according to claim 1, wherein said void of said outer sleeve closely matches the dimensions of said blister card such said blister card is only slidable relative to said outer sleeve in directions into and out of said outer sleeve.

5. A package according to claim 4, wherein said blister card includes a pair of transverse fold lines that defines an intermediate panel, and wherein said blister card is foldable such that when said blister card is in said storage position, said intermediate panel is positioned in said open end of said outer sleeve and substantially closes said open end.

6. A package according to claim 4, wherein said blister card includes one or more plastic sheets having been molded to provide said blister compartments and said latch.

7. A package according to claim 6, wherein said blister card includes two layers of paperboard which are adhesively sealed together and which sandwich said at least one plastic sheet therebetween, one of said layers of paperboard includes openings through which said blister compartments project, and the other one of said layers of paperboard includes break-away tabs aligned underneath said blister compartments.

8. A child-resistant, senior-friendly package for containing tablets or like separate dispensable items, comprising:

an elongate, relatively-thin, relatively-rectangular paperboard outer sleeve having upper and lower wall panels, opposed longitudinally-extending side edge panels, an open end and a closed end and defining a substantially rectangular void therein; and a separate blister card including a plurality of transparent plastic blister compartments projecting from a face of an elongate paperboard strip, said blister card including a tail end from which a latch projects from said face and from which a reversely-folded flap extends underneath said tail end on an opposite side of said strip relative to said latch;

said blister card being slidably within said outer sleeve between a storage position in which said blister card is housed within said outer sleeve and a dispensing position in which said blister card at least partially extends from said open end of said outer sleeve;

said outer sleeve having a transversely-extending locking ledge bonded to an internal surface of said upper wall panel of said outer sleeve which cooperates with said latch of said blister card to form a locking engagement thereby locking said blister card within said outer sleeve in said storage position, said reversely-folded flap of said tail end of said blister card resiliently urging said blister card and latch in a direction into said locking engagement;

said outer sleeve having opposed squeeze locations defined on said opposite side edge panels that correspond to opposite ends of said ledge such that said locking engagement between said ledge and said latch is released when said outer sleeve is squeezed at said opposed squeeze locations on said opposite side edges of said outer sleeve;

said blister card having a predetermined width such that said predetermined width of said tail end of said blister card adjacent said latch is less than said predetermined width at other locations of said card;

said void of said outer sleeve having a predetermined width, and said predetermined width of said blister card at said other locations closely matching said predetermined width of said void to prevent squeezing of said outer sleeve between said opposite side edges of said outer sleeve except at said opposed squeeze locations on said opposite side edges of said outer sleeve which corresponds to said location of said tail end, ledge and latch;

said ledge becoming arched away from said latch when said opposed squeeze locations on said opposite side edges of said outer sleeve are squeezed toward one another to release said locking engagement of said latch with said ledge; and said latch having a front wall with a stepped face for accommodating a mating contour of said ledge in said locking engagement, and said latch having a rear wall with a smooth taper to permit said latch to readily pass by said ledge when said card is returned to said storage position.

9. A package according to claim 8, wherein said blister card includes a pair of transversely-extending intermediate fold lines that define an intermediate panel, and wherein said blister card is foldable upon itself such that, when said blister card is in said storage position, said intermediate panel is positioned in said open end of said outer sleeve and substantially closes said open end.

10. A package according to claim 9, wherein said elongate paperboard strip of said blister card includes two layers of paperboard in which an upper one of said layers of paperboard includes openings through which said blister compartments and said latch project and a lower one of said layers of paperboard includes break-away tabs defined by perforations aligned underneath said blister compartments.

* * * * *